United States Patent [19]

Rule et al.

[11] Patent Number: 4,502,551

[45] Date of Patent: Mar. 5, 1985

[54] DEEP DRAFT DRILLING PLATFORM

[76] Inventors: Kenneth C. Rule, 1121 Heatherwood La., Fort Collins, Colo. 80525; Frank W. Michael, 935 Valley View Rd., Fort Collins, Colo. 80524

[21] Appl. No.: 364,491

[22] Filed: Apr. 1, 1982

[51] Int. Cl.[3] ..... E21B 7/124; E21B 7/132

[52] U.S. Cl. ..... 175/6; 175/8; 166/350; 166/356; 114/264

[58] Field of Search ..... 166/350, 351, 352, 356; 175/5, 6, 8; 114/121, 125, 144 B, 264; 441/28

[56] References Cited

U.S. PATENT DOCUMENTS

| | | | |
|---|---|---|---|
| 2,553,798 | 5/1951 | Van Deventer | 441/28 |
| 3,095,048 | 6/1963 | O'Neill et al. | 175/6 |
| 3,442,339 | 5/1969 | Williamson | 175/6 |
| 3,661,204 | 5/1972 | Blanding et al. | 175/6 |
| 3,709,307 | 1/1973 | Clark | 114/264 |
| 3,902,553 | 9/1975 | Jergins | 175/8 |
| 4,040,667 | 8/1977 | Tax et al. | 299/8 |
| 4,054,104 | 10/1977 | Haselton | 175/8 |

*Primary Examiner*—Stephen J. Novosad
*Assistant Examiner*—William P. Neuder
*Attorney, Agent, or Firm*—Young & Martin

[57] ABSTRACT

A deep draft oil well drilling platform having a large hollow body is shaped, designed, and ballasted to have a substantial portion thereof submerged under the surface of the ocean a sufficient distance to be substantially unaffected by surface waves and weather. The body contains an oil well drilling rig and all supplies, equipment, and materials normally necessary to drill an oil well, with such rig, equipment, and the like positioned well below the surface of the water.

9 Claims, 9 Drawing Figures

DEEP DRAFT DRILLING PLATFORM

BACKGROUND

The present invention is related to offshore oil well drilling platforms, and more specifically to a deep draft drilling platform in which a drilling rig is positioned below the surface of the water.

In well drilling operations, derricks are positioned over the well to provide a structure high above the well from which to suspend elongated sections of drilling pipe. In offshore drilling operations, it has become customary to provide large floating platforms on which such derricks or drilling rigs are positioned for well drilling operations. In addition, the required machinery, pumps, equipment, tanks, supplies, and personnel accommodations are also placed on the large floating drilling platforms. The floating platforms are usually positioned high above the surface of the water in order to place the derrick and such other equipment above surface wave action.

Although such conventional offshore drilling platforms have been used successfully to drill many offshore wells, the use of such platforms continues to present substantial safety problems. In particular, such floating drilling platforms with equipment and facilities supported high above the surface of the water, are unstable and dangerous in storm conditions and rough seas. Many lives have been lost as a result of such large floating drilling platforms capsizing and sinking in severe weather. Such conventional floating platforms are also dangerous when blowouts occur, since all of the personnel are confined to the area immediately adjacent the oil well where extreme fire and explosive conditions are particularly perilous and the ability to control such fires is inhibited by the ocean environment.

SUMMARY OF THE INVENTION

Accordingly, it is an object of the present invention to provide a novel well drilling platform that is stable and safe in an ocean environment, even in severe weather and rough seas.

Another object of the present invention is to provide a drilling platform that is submersible a sufficient depth below the surface of the water that surface conditions of waves and weather have minimal effect on the stability of the platform.

It is also an object of the present invention to provide a submersible drilling platform wherein the derrick and oil drilling equipment are positioned a substantial distance below the surface of the water.

It is also an object of the present invention to provide a submersible drilling platform that is a self-contained environment for total support of drilling operations as well as personnel comfort and accommodations for drilling crews.

It is a further object of the present invention to provide a submersible drilling platform that is mobile and can be self-propelled in any desired direction.

A still further object of the present invention is to provide a submersible craft for well drilling, coring, mining, or other operations on or in the sea bed through the bottom of the craft.

It is also an object of the present invention to provide a submersible craft for offshore oil well drillings, coring, mining, or other operations in which the center of buoyancy is positioned a significant depth below the surface of the water and the center of gravity is positioned a significant distance below the center of buoyancy to achieve maximum stability.

Another object of the present invention is to provide a drilling platform with an enclosed chamber of limited space around the oil well opening for controlling fire hazards in the event of well blowouts.

In keeping with the above objects, this invention includes a submersible well drilling platform from which to conduct offshore well drilling operations and method of using same. The submersible platform is in the form of a large hollow body large enough to contain an oil well drilling rig therein as well as all normally necessary materials, equipment, operation controls, and human support facilities a sufficient distance below the surface of the ocean to be substantially unaffected by surface wave action and weather. The platform has an opening in its bottom through which to conduct drilling operations. If the opening is not sealed, as in the preferred embodiment, the interior of the platform is pressurized to keep water out of the interior.

The platform includes a sufficiently large body portion and narrower elongated top portion to have a center buoyancy nearer the bottom than the top, and it has its weight and ballast distributed to place the center of gravity well below the center of buoyancy for stability. Basically, the heaviest ballast, drilling mud, liquid supplies and chemicals, drill pipe sections, and heavy machinery are positioned as low in the platform as possible while less dense uses, such as operations and controls, human services areas, and the like are located in the upper portions of the platform.

The platform also includes a self-propulsion system for mobility and position control. An outer protective hull can also be provided to absorb shock from collisions, and the like. The space between the outer and inner hulls is preferably filled with a non-compressible fluid such as sea water to absorb and distribute shock forces from such a collision. Some restricted openings in the outer hull can also be provided to allow a controlled rate of flow out of the space to cushion the impact forces of a collision.

BRIEF DESCRIPTION OF THE DRAWINGS

Other objects, advantages and capabilities of the present invention will become more apparent as the description proceeds, taken in conjunction with the following drawings in which.

DETAILED DESCRIPTION OF THE PREFERRED EMBODIMENT

Figure 1:
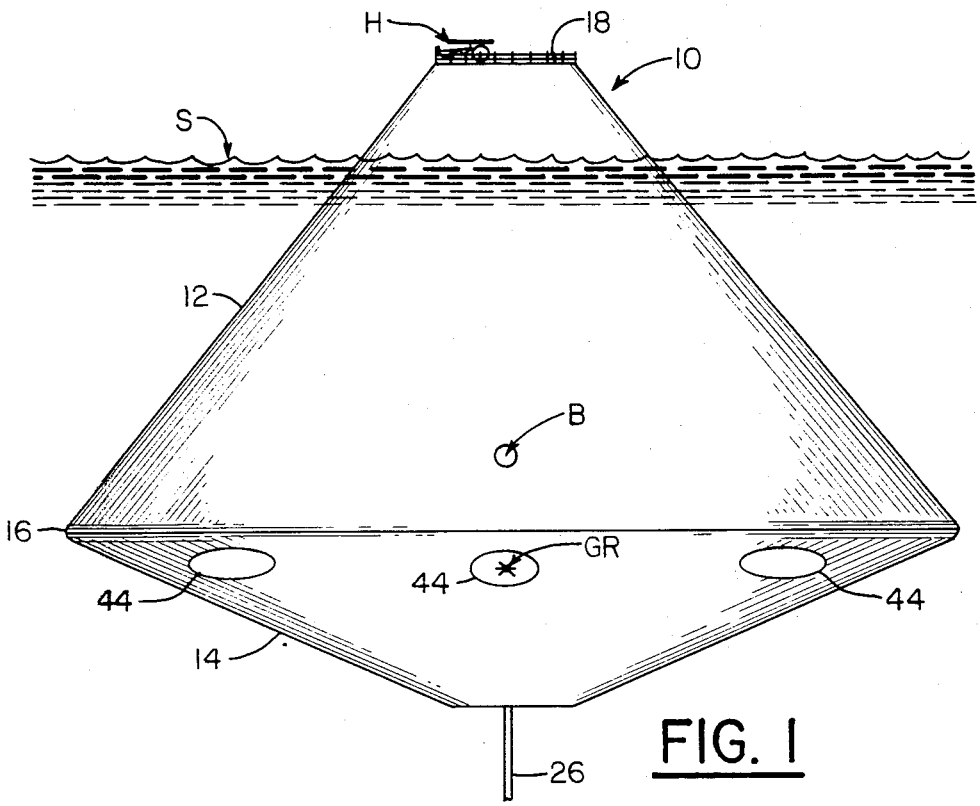
FIG. 1 is an elevation view of the deep draft drilling platform of the present invention.
Figure 2:
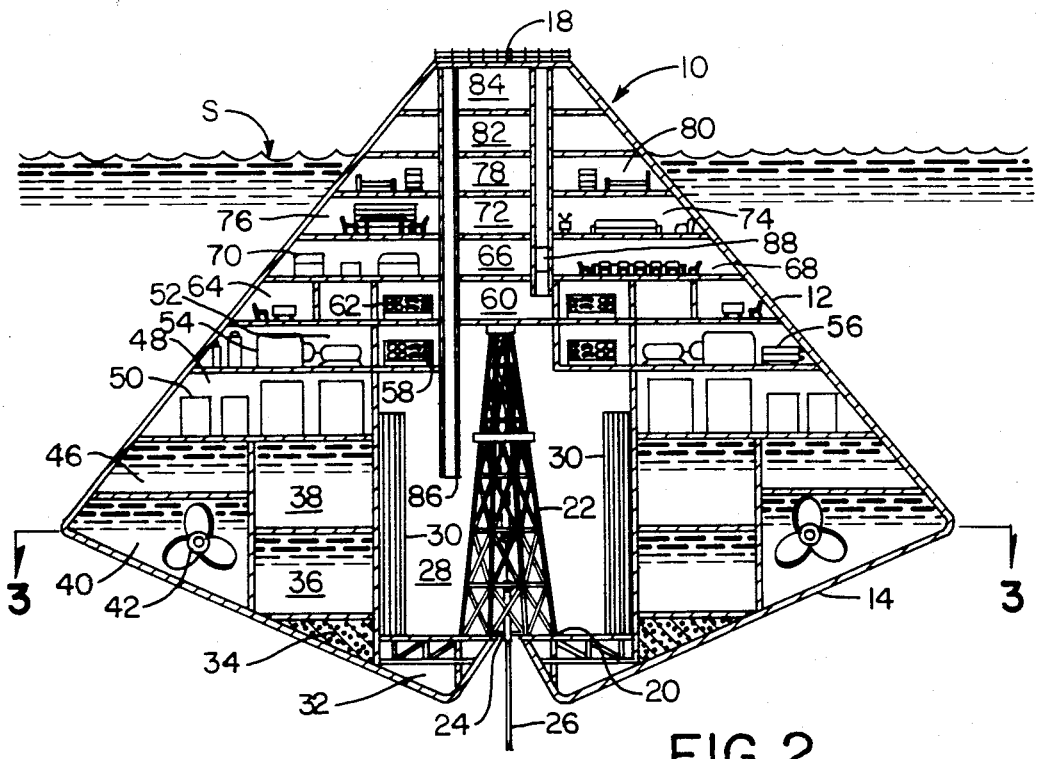
FIG. 2 is a cross-sectional view of the deep draft drilling platform of the present invention.
Figure 3:
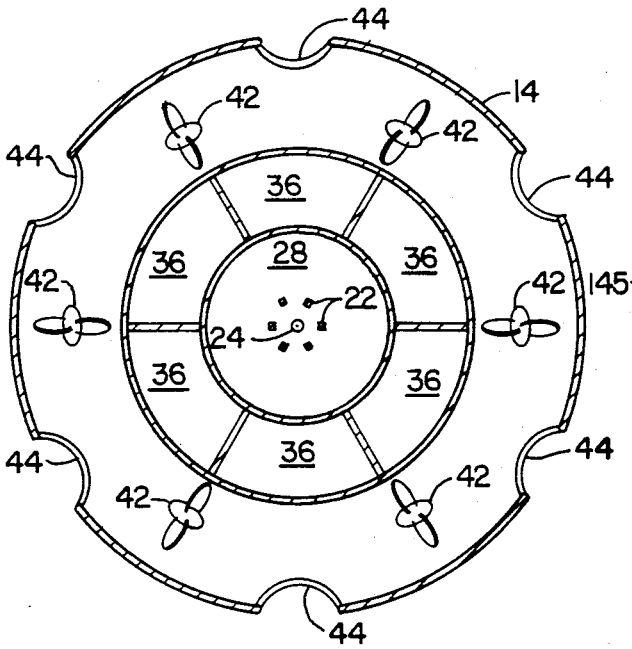
FIG. 3 is a cross-sectional plan view taken along line 3—3 of FIG. 2.

The deep draft drilling platform 10 of the present invention as shown in FIGS. 1 through 3 is designed to contain oil well drilling equipment in its interior well below the surface S of the ocean water for drilling offshore oil wells. The drilling platform 10 is designed specifically to operate with most of its volume and its center of buoyancy a sufficient distance below the surface S of the ocean so that it is substantially uneffected by extreme weather conditions or rough surface conditions on the sea. In accomplishing these purposes, the deep draft drilling platform 10 of the present invention is formed with an upper section 12 in the shape of a truncated cone having an altitude approximately equal to or slightly less than the diameter of the base or widest section 16, and a lower portion 14 in the shape of a much flatter truncated inverted cone with an altitude approximately $\frac{1}{3}$ of the length of the altitude of the upper section 12. The craft or platform 10 is preferably designed and shaped so that its center of buoyancy B is closer to its bottom than to its top and positioned in the range of several hundred feet below the surface S of the water. In order to maintain maximum stability, the craft 10 is preferably weighted with ballast, equipment and supplies in such a manner that the center of gravity is a significant distance below the center of buoyancy.

The structure and interior of the preferred embodiment of the drilling platform 10 of the present invention is best seen in FIG. 2. The primary working area or drill room 28 is provided in the lower central portion of the craft or platform 10. It includes a drilling floor 20 on which is positioned a derrick 22. The interior of the drilling room 28 is of sufficient height to completely contain the derrick 22 therein. A hole 24 in the center of the drilling floor 20 is provided to allow the drilling pipe or casing 26 to extend downwardly from the derrick 22 and out the bottom of the craft 10 to the ocean floor. The drilling room 28 is preferably enough to also contain other ordinary drilling equipment and supplies such as sections of drill pipe 30 stacked along its sides.

A bilge 32 is provided at the lowest portion of the craft 10 to collect any water that leaks into the craft. Bilge pumps (not shown) can be provided to pump water out from the bilge area as required.

It is necessary to weight and ballast the craft 10 to submerse it to the desired depths as shown in FIG. 2. Such ballast and weighting is provided in several ways, with the primary object being to distribute the heaviest materials as close to the bottom of the craft 10 as possible, while positioning the lighter materials and less dense special uses of the craft in the upper levels. For example, in the craft 10 shown in FIG. 2, an annular chamber 34 is filled with a solid ballast, such as slag or iron, which is very dense and heavy. Two annular tank compartments 36, 38 positioned above the solid ballast compartment 34. These liquid compartments 36, 38 can be filled with drilling mud for use both as ballast for the craft 10 and for circulation into the oil well to control reservoir pressure and carry cuttings to the surface of the well. Since drilling mud is usually much heavier than sea water, the storage of large quantities of such mud in the tank compartments 36, 38 provides an effective ballast around the drill room 28 to weight the craft 10.

Two additional annular ballast compartments 40, 46 are positioned outward from the mud ballast tanks 36, 38 in the widest portion 16 of the craft 10. These outer compartments 40, 46 are intended primarily to contain sea water ballast. Appropriate pumps, compressors, and other machinery would be provided to blow out the sea water ballast or to draw in the sea water ballast as required to maintain the craft 10 submerged to the required depth.

The annular ballast chamber 40 also has positioned therein in spaced apart relation to each other a plurality of propulsion turbines 42 as best shown in FIGS. 2 and 3. A plurality of ports 44 are positioned in spaced apart relation to each other around the periphery of the craft 10, as shown in FIG. 3, for drawing in and discharging sea water for propulsion purposes. Each of the turbines 42 is provided with reversible drive means as well as with reversible vanes so that each one is capable of driving water in both forward and reverse direction. It is possible therefore to propel the craft in any desired direction or to rotate the craft by appropriate directional control of the individual turbines 42. For example, if the three turbines on one side are driven to propel water through from the front to the aft of the craft 10, and the three turbines on the opposite side are also driven to propel water from the front to the aft of the craft 10, the craft 10 will move forwardly. Reversal of direction of all of the turbines would move the craft rearwardly. By driving selected ones of these turbines 42 in forward and reverse directions, and craft 10 can also be moved sideways and rotated. Therefore, the craft 10 is provided with a high degree of mobility, while the turbines 42 are not exposed to the exterior of the craft 10 where they could be damaged by contact with solid objects, such as icebergs, rocks, and the like.

The level 48 above the ballast tanks is preferably used for the storage of heavy materials, such as cement, chemicals, mud mixing materials, and the like. As shown in FIG. 2, tanks 50 are provided for storage of such heavy liquids in this level 48.

The next level up, level 52, is preferably used for heavy equipment and machinery, such as generators, cryogenic air distillation, storage, and mixing apparatus, pumps, machine tools, and the like. Again, the goal is to place the heaviest objects toward the bottom of the craft 10 to maintain the center of gravity GR as low as possible. The power generators 54 and cryogenic storage facilities 56 shown in FIG. 2 illustrate such uses. Also, a first control room 58 is provided toward the central portion of level 52 from which all power systems, atmospheric control systems, pressurizing systems, life support systems, propulsion systems, sonar, radar, and the like can be controlled.

In level 60, which is shown in FIG. 2 in the upper half of the craft, less dense personnel service use areas are provided, as well as a secondary or backup control room 62, offices 64 and the like.

The personnel service level 66 is also a light density usage area for such things as a mess hall 68, kitchen 70 and the like. The next level 72 is also a low density personal comfort usage area, such as lounge 74, library 76, infirmary (not shown) and the like. The next level up, level 78, is used for bedrooms, heads, showers and other personal crew uses. The top levels 82, 84 are also preferably designated for light density uses, such as recreational areas and light storage. An exterior deck 18 is provided at the top of the craft 10 for receiving goods, landing helicopters H, outdoor recreation, and the like.

Since the bottom of the craft is open at the drill floor 20 a substantial distance below the surface S of the sea, measures must be taken to prevent entry of sea water into the drilling room 28. In the preferred embodiment shown in FIG. 2, it is contemplated that the drilling room 28 as well as the heavy materials storage level 48 and heavy equipment level 52 would have a sufficient atmospheric pressure maintained therein to prevent entry of sea water. For example, if the bottom of the craft 10 is positioned approximately 400 feet below the surface S of the sea, the drilling room 28 would be maintained with an interior atmospheric pressure of approximately 13 times normal atmospheric pressure. Upper levels 60, 66, 72, 78, 82, 84 could be maintained at correspondingly decreased atmospheric pressures in relation to the depth of such levels below sea level S. For example, level 60 might be maintained at approximately 6 to 8 atmospheres, level 66 at 4 to 6 atmospheres, and levels 72 and 78 at approximately 2 to 3 atmospheres. Of course appropriate sealed hatches and pressure transfer chambers (not shown) have to be provided to accommodate personnel movement between levels while maintaining the different atmospheric pressures therein.

Elevator shafts 86, 88 are shown in FIG. 2 for transporting personnel and supplies from the service deck 18 into the interior of the craft 10. For example, elevator shaft 86 extends from service deck 18 into the drilling room 28. This elevator shaft 86 could be in the form of an elongated tube with appropriate pressure seals at top and bottom and heavy material handling equipment for loading supplies, such as drill pipe section 30, casing sections, and the like into the drilling room 28. Other elevators, such as 88, are provided to move conventional freight, supplies, and personnel into various upper levels of the craft 10. Of course, appropriate seals and pressure chambers must be provided at each level to maintain the atmospheric pressures therein.

Besides holding the sea water from flowing into the bottom of the drill room 28, maintenance of such interior atmospheric pressures also has the advantage of requiring less structural strength in the walls of the vessel 10 to resist the pressure of the sea water on the exterior thereof. However, personnel requirements must also be accommodated. In order to prevent occurrences of the "bends" resulting from nitrogen dissolved in a person's blood, the atmosphere inside the craft 10 is preferably artificially created to be devoid of nitrogen. A mixture of helium and oxygen is preferred. Since helium is less soluble in a person's blood than nitrogen, fewer problems would be encounterd by personnel moving from one pressure level in the vessel to another pressure level. It is also known that people can work for extended periods of time in a high pressure environment of oxygen and helium without any adverse effects. Therefore, the cryogenic equipment 56 is provided in the craft to distill oxygen from the atmosphere above the craft and to mix the oxygen with helium to create an appropriate artificial atmosphere of the desired pressure at various levels in the craft. Of course, other environmental control equipment, such as heating, air conditioning, water and waste treatment facilities, and the like are provided.

It is also contemplated that the craft 10 be provided with modern navigational and detection equipment, such as sonar, radar, periscopes, radio transmitting and receiving equipment, and the like for detection of objects such as icebergs or other dangers in the area as well as to pin point and maintain location of the well on the ocean floor and to communicate with others not on the platform. Instrumentation would also be provided for detecting and monitoring draft or movement in any direction, depth of the craft in the water, the amount of freeboard above the surface S of the water, atmospheric pressures and gas mix rations, amounts of mud and sea water ballast in each tank, and positions and weights of all supplies and moveable equipment and material. It is preferable that all critical control, monitoring, and power equipment required to provide and maintain essential operations and human support systems be provided in duplicate in separate enclosed chambers in the craft for safety and back up in the event of equipment or structural failure or other emergency.

Figure 4:
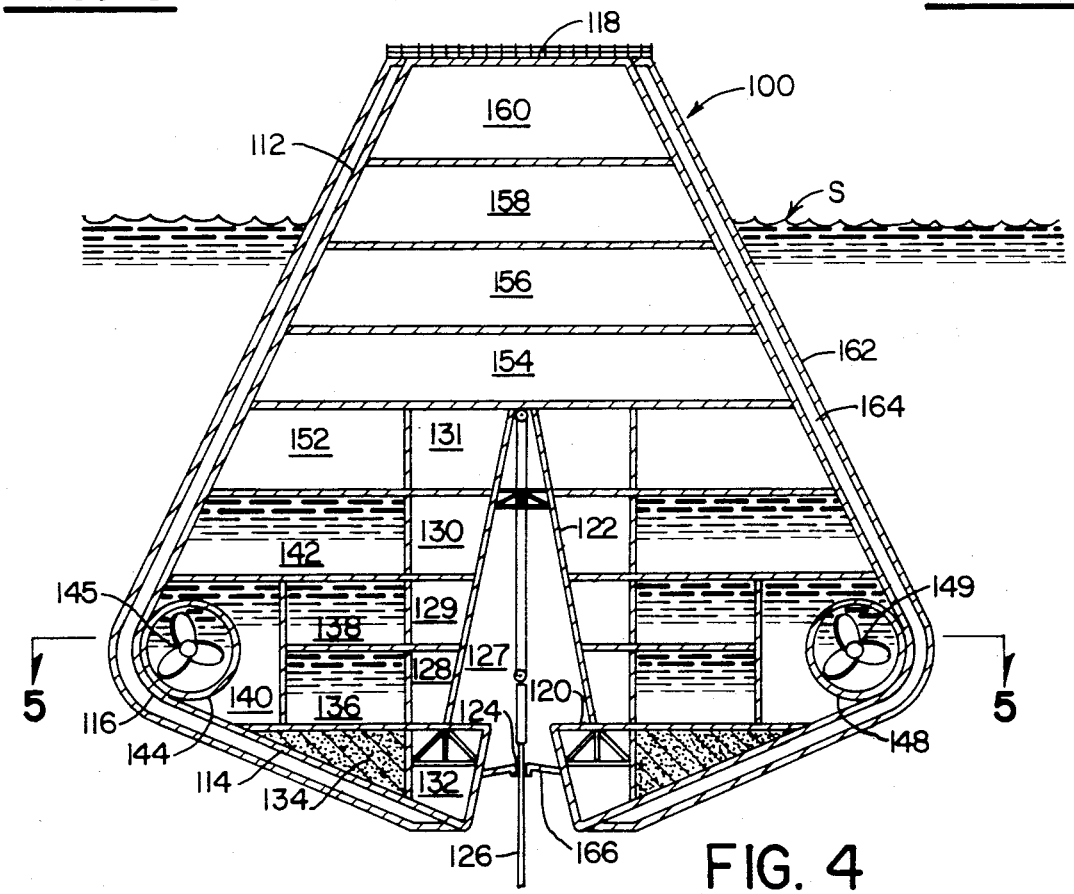
FIG. 4 is a cross-sectional view in elevation of an alternate embodiment of the present invention.

An alternative embodiment 100 of the submersible drilling platform of the present invention is shown in FIG. 4. The drilling platform 100 of this embodiment is shaped somewhat similar to the preferred embodiment 10 described above; however, the upper conical section is higher and narrower which has the effect of deepening the center of buoyancy below the surface of the water for increased stability. This embodiment 100, as in the preferred embodiment 10, includes a bilge 132 for collection of water leakage, a solid ballast compartment 134, liquid mud ballast compartments 136, 138 and sea water ballast chambers 140, 142. As described above for the preferred embodiment 10, this embodiment 100 is also designed with the distribution of supplies and equipment so that the heavier and more dense equipment and supplies is placed toward the bottom, and the lighter of less dense usages positioned at the top of the craft 100. Although illustrations of such equipment are not shown, it is contemplated for example that level 152 be used for storing heavy materials, level 154 be used for heavy equipment, level 156 be used for operations, level 158 be used for personnel services, and level 160 for private personal usages.

This alternative embodiment also includes several other variations that would be advantageous under certain circumstances or conditions. For example, instead of a derrick on the drill floor 120, a conically shaped bulk head 122 is provided to extend upwardly from the drill floor 120 to enclose a drill room 127. The advantage of such an enclosed drill room 127 is that it provides a limited space or atmosphere around the well head which can enhance safety in several ways. For example, if the well should blow out and catch on fire, the fire could not burn very long in the limited space of the drilling room 127 inside the conical bulk head 122. The oxygen in that room 127 would be quickly consumed, and, if additional oxygen supply was shut off, the fire would be sufficated quite rapidly. For personnel safety, work areas or crew areas 128, 129, 130, 133 are provided outside the drill room 127 for quick escape. Also, the conical shape of the bulkhead 22 provides a strong structure for maintaining differential pressures inside and outside the drill room 127. Such a chamber could also be flooded with sea water rapidly to snuff out a fire. Although not shown in FIG. 4, appropriate elevators, ladders, and hatchways are provided between floors or chambers for the movement of personnel and material therein.

Figure 6:
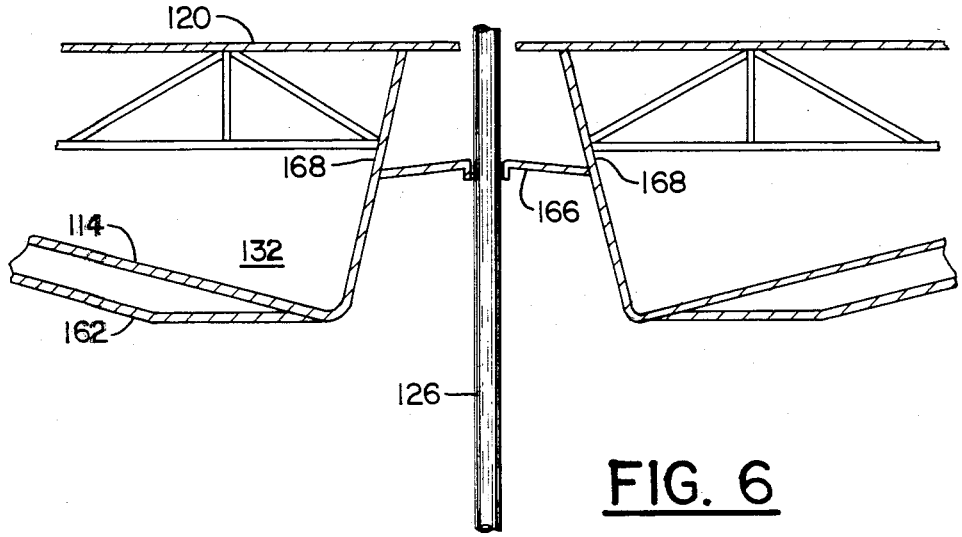
FIG. 6 is an enlarged view of the drill floor, bilge, and sea water restriction plate area of the alternative embodiment shown in FIG. 4.

Another advantage of the enclosed room 127 is that if for some reason the craft 100 was lifted a significant extent or submerged to a significant extent by a very large wave, only a limited amount of water could enter the craft. A further safety feature to keep out excess water from the drill room 127 is provided in the form of an annular restriction plate 166 extending inwardly from the hull to the drill stem 126 as shown in FIG. 4 and FIG. 6. Therefore, even with a large change in pressure, water could enter into the drilling room 127 only at a very limited rate. In fact, for all practical purposes only a very limited amount of water could flow between the restrictor plate 166 and through the openings 168 in the hull to the bilge 132 where it could be pumped out. Further, although it is not shown, if it is desired to maintain the interior of the craft 100 at normal atmospheric pressure, a seal could be provided between the restrictor plate 166 and drill stem 126 to prevent any significant entry of sea water therein. Of course the bulkheads and hull of the craft would also have to be designed and built with sufficient strength to withstand the external water pressure if the craft was to be operated with a normal atmospheric pressure inside.

Another feature of the alternative embodiment, as shown in FIG. 4, is the double hull structure. An outside shell or hull 162 is positioned a spaced distance outwardly of the normal hull leaving a space 164 therebetween. The space 164 is preferably filled with sea water to provide a non-compressible bumper to protect the interior hull as well as other mechanisms in the event the craft should collide with a solid object such as an iceberg or the like. The water jacket in the space 164 would tend to distribute the impact forces over a wide area to minimize damage from such impact. Several small outlet holes 165 can be provided in the outer hull 162 near its top to allow water to escape the space 165 at a controlled rate to further cushion the effect of an impact that bends the outer hull 162 inward toward the main hull.

Figure 5:
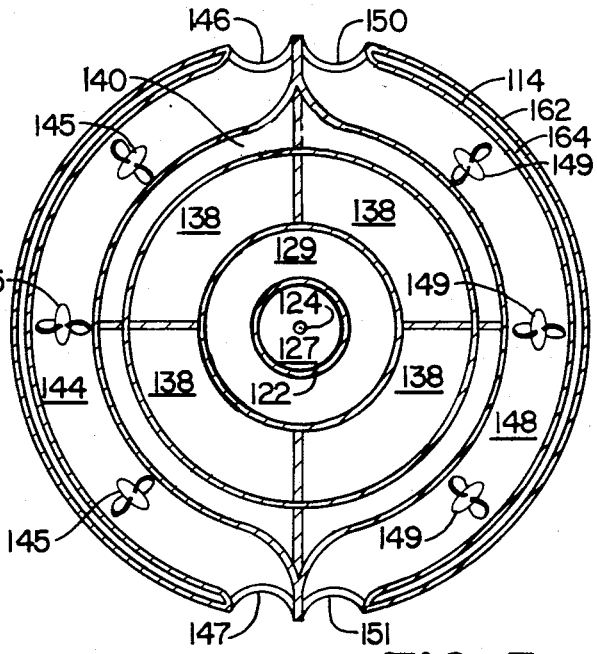
FIG. 5 is a cross-sectional plan view of the present invention taken along line 5—5 of FIG. 4.

As best seen in FIGS. 4 and 5, the alternative embodiment 100 also includes a different propulsion system. A first propulsion tube 144 extends circumferentially around one side of the craft 100 from a forward port 146 to an aft port 147. A plurality of turbines 145 are positioned in spaced apart relation to each other in the propulsion tube 144. These turbines are reversible in rotation as well as being provided with reversible vanes for backup.

A second propulsion tube 148 is positioned circumferentially around the other side of the craft 100 extending from a forward port 150 to an aft port 151. A plurality of reversible turbines 149 are also positioned in the second propulsion tube 148. If it is desired to move the craft 100 forward, all of the turbines 145, 149 are driven to draw water in the forward ports 146, 150 and discharge the water out the aft ports 147, 151. If it is desired to move the craft in the opposite direction, the turbines 145, 149 are driven in the opposite direction to draw water in the aft ports 147, 151 and discharge the water out forward ports 146, 150. Further, if it is desired to rotate the craft 100 clockwise, the turbines 145 in propulsion tube 144 are driven in the forward direction, and the turbines 145 in the propulsion tube 148 are driven in a reverse direction. If it is desired to rotate the craft counter-clockwise, the turbines 149 in propulsion tube 148 are driven in the forward direction, and the turbines 149 and propulsion tube 144 are driven in the reverse direction.

Figure 7:
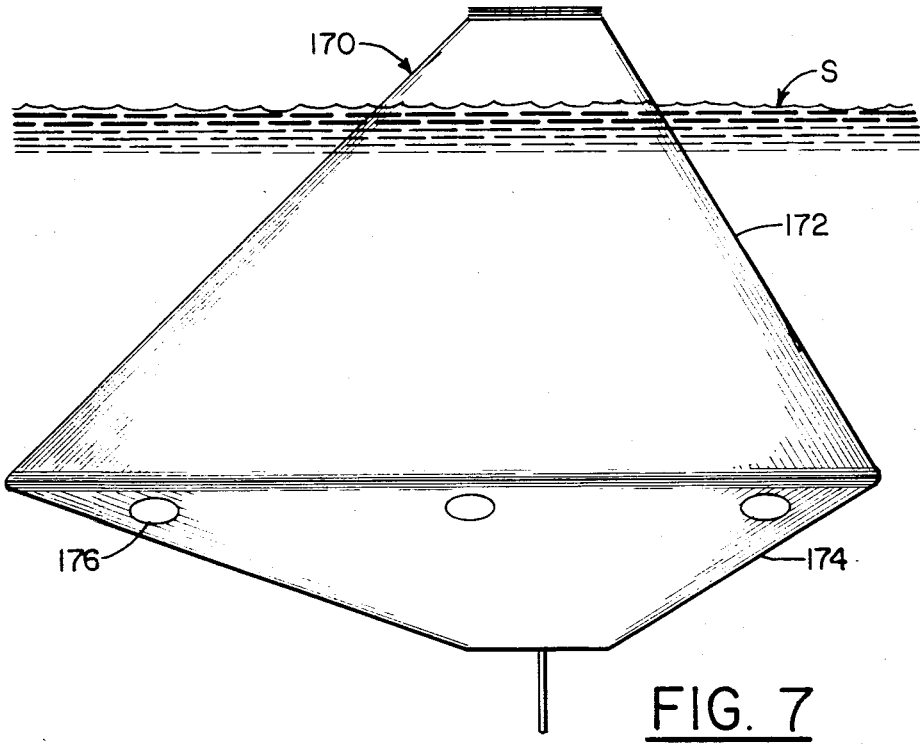
FIG. 7 is an elevation view of another alternative embodiment of the present invention having eliptical cross-section.

Although the preferred embodiments are shown with conical structures, other structures may also be appropriate as long as they are conducive to providing a low center of buoyancy positioned well below the surface of the water and a center of gravity a sufficient below the center of buoyancy to provide stability. Such suitable shapes generally include a rather wide body portion near the bottom with a more narrow, elongated top portion extending upwardly from the wider bottom portion. For example, in the alternative embodiment 170 shown in FIG. 7, the hull is primarily eliptical in cross-section. The upper portion 172 is a somewhat elongated slanted conical section with an eliptical cross-section. This structure places the upper portion of the craft in a somewhat offset or non-concentric configuration. Such a craft 170 would encounter less resistance to movement through the water and would be appropriate where higher speed, more efficient movement is desired or required. The propulsion system could be similar to that described in the preferred embodiments above with interior turbines (not shown) drawing in and discharging water through approrpriate external ports 176 in the lower portion 174 of the hull.

Figure 8:
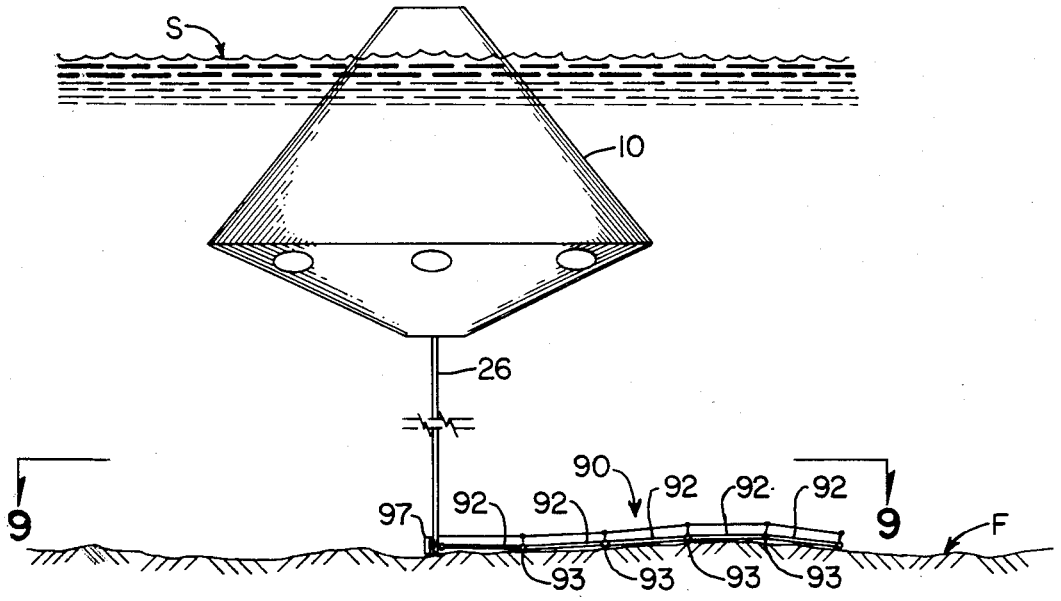
FIG. 8 is an elevation view of the deep draft drilling rig of the present invention with a mining tool attached to the drill string thereof.
Figure 9:
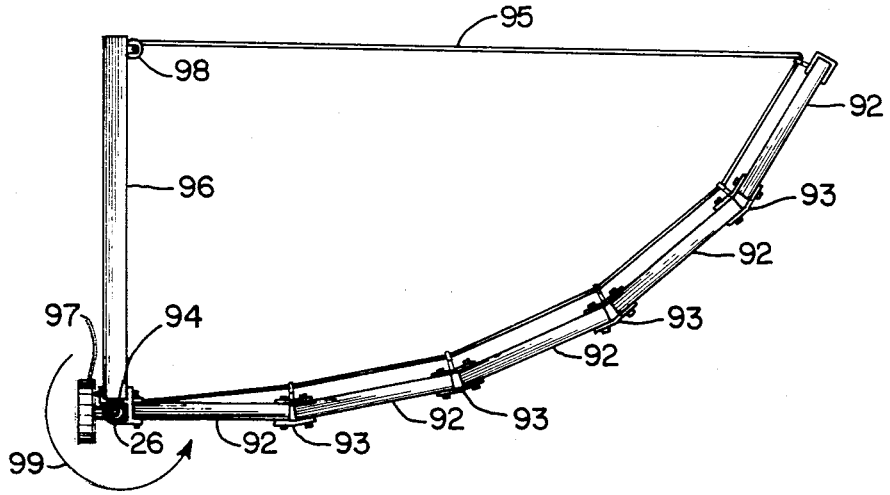
FIG. 9 is a plan view of the mining tool taken along line 9—9 of FIG. 8.

It is also contemplated that the deep draft drilling platform 10 of the present invention could also be used advantageously for mining the ocean floors, such as for scraping mineral nodules into windrows or piles where they can be picked up by appropriate conventional equipment. For example, as shown in FIGS. 8 and 9, a rotatable mining tool 90 is attached to the bottom of drill stem 26 extending below the submersible drilling platform 10 of the present invention. The scraper tool 90, shown for illustrative purposes herein, includes a plurality of articulated sections 92 hinged together by hinges 93 for sweeping over contoured portions of the ocean floor F. As shown in the plan view in FIG. 9, taken along line 9—9 of FIG. 8, the articulated sections 92 are formed in an arc so that when the tool 90 is rotated in the direction indicated by arrow 99, mineral nodules and other materials on the ocean floor will be scraped toward the center or drill stem 26. A boom 96 extends outwardly at an angle from the articulated sections 92 to anchor a cable 95 attached to the articulated sections 92 to help strengthen and maintain the arcuate configuration of the mining tool. The cable 95, shown positioned over a pulley 98 in the distal end of the boom 96, can be returned to a winch (not shown) at the bottom of the drill stem 26 and turned independently of the drill stem 26 by inner tube 94 if desired to tighten the cable 95. A wheel 97 is positioned at the bottom of the drill stem 26 to support the drill stem 26 as it rotates over the ocean floor.

While the present invention has been described with some degree of particularity, it should be appreciated that the present invention is defined by the following claims construed in light of the prior art so that modifications or changes may be made to the preferred embodiment of the present invention without departing from the inventive concepts contained herein.

What I claim is:

1. An offshore drilling platform, comprised of a submersible body that includes a sufficiently large bottom portion and narrower elongated top portion to have a center of buoyancy nearer its bottom than its top and weighted disproportionately at its bottom to have a center of gravity of the platform a sufficient distance below the center of buoyancy to stabilize the platform in a submerged condition, wherein said platform includes a main hull enclosing an interior drilling room chamber with well drilling equipment and working environment therein positioned a sufficient depth below the surface of the ocean as to be in substantially quiet water unaffected by surface wave action and adverse weather conditions, said interior drilling room chamber being in the center of said bottom portion, and said platform including annular ballast chambers in the bottom portion around the periphery of said drilling room chamber for containing heavy materials to weight said platform to provide a center of gravity substantially below the center of bouyancy, and additional pressure isolated chambers within said main hull above said ballast and drilling room chambers for operational and system control and human support, said additional chambers being designatd for uses according to descending weight and density requirements for such uses as the altitudes of such chambers ascend upwardly, with heavy supplies of drilling chemicals, cement, oil based mud, and other fluids as well as heavy equipment are positioned in the chambers just above the ballast chambers, and less dense personnel service and support facilities are positioned in the upper chambers of the platform.

2. The offshore drilling platform of claim 1, including a drilling foor at the bottom of said drilling room chamber with an opening therein for protrusion therethrough of a string of drill pipe extending from said drilling equipment in said drilling room chamber to the ocean floor below the platform, and including seal means around said drill pipe string to prohibit flow of sea water into said drilling room chamber regardless of pressure therein.

3. The offshore drilling platform of claim 1, including a protective external hull shell enclosing the main hull a spaced distance outwardly from the main hull with the space between said hulls being filled with a non-compressible fluid.

4. The offshore drilling platform of claim 3, including a relatively small opening in said external hull to exhaust water from said space at a controlled flow rate in the event a portion of said external hull is pushed inwardly toward said main hull.

5. An offshore drilling platform, comprised of a submersible body that includes a sufficiently large bottom portion and narrower elongated top portion to have a center of buoyancy nearer its bottom than its top and weighted disproportionately at its bottom to have a center of gravity of the platform a sufficient distance below the center of bouyancy to stabilize the platform in a submerged condition, wherein said submersible body is in the form of two truncated conical sections having a common base, the upper one of said conical sections having an altitude at least two-thirds as large as the diameter of the common base, and the lower one of said conical sections having an altitude of not more than one-third the altitude of the upper conical section.

6. The offshore drilling platform of claim 5, including propulsion means for moving the platform and for maintaining position of said platform in relation to a well being drilled in the ocean floor, wherein said propulsion means includes an elongated chamber extending concentrically around the periphery of said platform and having a plurality of port openings therein in spaced apart relation to each other around the periphery of said propulsion chamber, and a plurality of turbines having reversible rotating drive means and reversible vanes positioned in spaced apart relation to each other in said propulsion chamber for pulling sea water in and discharging the sea water out selected ones of said port openings as desired depending on the direction it is desired to move the platform.

7. The offshore drilling platform of claim 6, including a first propulsion tube extending from an opening in front of the platform around one side to an opening in the aft of the platform and reversible turbine means in said first propulsion tube for pumping sea water therethrough, and a second propulsion tube extending from an opening in front of the platform around the other side to an opening in the aft of the platform and reversible turbine means in said second propulsion tube for pumping sea water therethrough.

8. The offshore drilling platform of claim 5, wherein said upper and lower conical sections are eliptical conical sections.

9. The offshore drilling platform of claim 5, wherein the longitudinal axis of said eliptical conical sections are slanted at an acute angle to the plane of said common base such that a straight line normal to the plane of said common base extends through the center of the distal end of the top conical section and through the center of the distal end of the bottom conical section.

* * * * *